US009202401B2

(12) United States Patent
Wong

(10) Patent No.: US 9,202,401 B2
(45) Date of Patent: Dec. 1, 2015

(54) TOUCH SENSITIVE CRYSTAL BALL

(71) Applicant: KiKin Wong, Dongguan (CN)

(72) Inventor: KiKin Wong, Dongguan (CN)

( * ) Notice: Subject to any disclaimer, the term of this patent is extended or adjusted under 35 U.S.C. 154(b) by 0 days.

(21) Appl. No.: 14/329,976

(22) Filed: Jul. 13, 2014

(65) Prior Publication Data

US 2014/0317971 A1 Oct. 30, 2014

(51) Int. Cl.
*G09F 19/02* (2006.01)

(52) U.S. Cl.
CPC ..... *G09F 19/02* (2013.01)

(58) Field of Classification Search
CPC ..... G09F 13/24; G09F 19/02
See application file for complete search history.

(56) References Cited

U.S. PATENT DOCUMENTS

| | | | | |
|---|---|---|---|---|
| 4,125,783 | A * | 11/1978 | Sefton | 307/116 |
| 5,620,353 | A * | 4/1997 | Lai | 446/136 |
| 6,310,611 | B1 * | 10/2001 | Caldwell | 345/173 |
| 6,449,887 | B1 * | 9/2002 | Song | 40/406 |
| 7,766,717 | B2 * | 8/2010 | Shapiro | 446/236 |
| 2014/0104204 | A1 * | 4/2014 | Hsieh et al. | 345/173 |

* cited by examiner

*Primary Examiner* — Casandra Davis

(57) ABSTRACT

The present invention relates to a decoration, toy technical scheme and the like, particularly to a touch sensitive crystal ball comprises a hollow glass ball and a base, which is characterized in that the hollow glass ball is used in the form of an opening in its lower part, where a conductive resin is disposed; the base is provided with an operating circuit; an electrode plate is arranged under the conductive resin and connected to the operating circuit, a touch switch is composed of the electrode plate, the glass ball and the conductive resin, since the user touch the glass ball, the operating circuit is opened by activating the electrode plate through static electricity from human body.

2 Claims, 6 Drawing Sheets

TOUCH SENSITIVE CRYSTAL BALL

FIELD OF THE INVENTION

The utility model relates to an ornament, toy, particularly to a touch sensitive crystal ball.

BACKGROUND OF THE INVENTION

Crystal ball, as it is commonly known, is a toy or a decoration provided with snow simulation in the present market. It usually includes a glass ball and a bearing base. The glass ball is often designed to a hollow which can put all kind of cartoon characters, small objects (snowflakes are made of foam material) and liquid therein. The objects inside the glass ball start to dance or wave as it's been shacked, which looks like whirling snowflakes and magic effects as a fairy tale.

To enhance magic effect, many crystal balls are added an electric devices for glowing effect or other more complicated mechanical action. The China Patent No. 201020523227.1 disclosed a technical scheme for the crystal ball, which comprises a base, a ball body, a doll, a circuit control system and traditional mechanism, the circuit control system includes a circuit, a sound control module for receiving the voice order, a timing module for adjusting the doll's action sequence, a speech module for playing ringtones and making the doll speaking, a lighting circuit and driving circuit. The aforementioned technical scheme is added an electric devices into the product. But, we also can learn all the circuits need to be installed inside the base, and then the circuit connected the internal mechanism by wires. Therefore, for the stability of the circuit and product, it must be fixed the glass ball body and the base in one piece, in this way, the product became an inseparable object, it is not only increased the times of manufacture, but also increase the cost, and need to redesign for each new product due to different models. In addition, the consumers cannot replace the doll inside the crystal ball depend on their preference, it reduce the desire to buy the product.

Besides, the person who has a certain static electricity, by this principle the touch sensitive switch has been developed, and the art is applied to the present invention.

SUMMARY OF INVENTION

The utility model overcomes the defects existing in the prior art, which provides a touch sensitive crystal ball for activating by electrostatic induction, it is convenient and interesting.

In order to solve the above problems, the technical scheme of the present invention is a touch sensitive crystal ball comprises a hollow glass ball and a base, which is characterized in that the hollow glass ball is used in the form of an opening in its lower part, where a conductive resin is disposed; the base is provided with an operating circuit; an electrode plate is arranged under the conductive resin and connected to the operating circuit, a touch switch is composed of the electrode plate, the glass ball and the conductive resin, since the user touch the glass ball, the operating circuit is opened by activating the electrode plate through static electricity from human body.

Further, the above technical scheme, the glass ball is provided with an ornament therein, and an upper magnet element is arranged below the ornament;

the base is internally provided with a gear box driven by a motor, of which an output shaft is interacted with a lower magnetic element having an magnetic interaction with the upper magnet element; the output shaft of gear box drives the lower magnetic element for operation, and then lead to the ornament located inside the glass ball is activated by utilizing the magnetism of the upper and lower magnetic elements; the motor of the gear box is connected to the operating circuit.

Further, the above technical scheme, the glass ball is filled with liquid.

Further, the above technical scheme, the output shaft of the gear box is fixedly connected with a connecting board on which the lower magnetic element is arranged, and comprises a plurality of magnetics in different directions of magnetic pole.

Further, the above technical scheme, the directions of magnetic pole in the magnetics are distributed in up and down, the upper magnet element is a magnetic, of which the direction of magnetism is distributed in up and down.

Further, the above technical scheme, the output shaft of the gear box is fixedly connected with a pendulum rod on which the lower magnetic element is arranged, wherein the lower magnetic element is a magnetic disposed on pendulum rod and at the end away from the output shaft.

Further, the above technical scheme, the direction of the magnetic pole in the lower magnetic element is distributed in up and down, the upper magnet element is the magnetic, of which the directions of magnetism are distributed in up and down, and the direction of the magnetic pole in the lower magnetic element is the same as the upper magnet element.

Further, the above technical scheme, the output terminal of the gear box is a connecting board capable of reciprocating motion, on which the lower magnetic element is arranged; The ornament is provided with a swing element, the upper magnet element disposed therebelow; The direction of the magnetic pole in the lower magnetic element is the same as the upper magnet element, the gear box drives the lower magnetic element of connecting board to do reciprocating motion, so the swing element (30) of the upper magnetic element (31) is being swung by the attraction of the magnetic.

The utility model has the advantages of that 1. the present invention adopts touch-sensitive method, by using the static electricity from human body, transmission through the conductive resin, electrode plate and circuit, so as to control the operating circuit to open, a touch switch is composed of the electrode plate, the glass ball and the conductive resin, since the user touch the glass ball, the operating circuit is opened by activating the electrode plate through static electricity from human body.
2. The glass ball and the base are separate objects, which are jointed to form a single unit, the ornament arranged inside the glass ball, and the operating circuit disposed inside the base, beside, there is no direct connection between the operating circuit and the ornament of the glass ball, so as to facilitate disassembly and assembly.
3. The utility model uses the magnetic force as a driving force to activate the ornament to operate. The glass ball and the bass are separate structures, users can choice different style of glass balls according to their preferences, so that the customers can spend less money to buy many different products and facilitate the assembling of manufacturer.
4. The utility model drives the operation of the lower magnetic element by the output shaft of the gear box, using the magnetic Interaction between the upper and the lower magnetic element to activate the ornament operating. In this driving way, there is no direct contact between the magnetic element as a driving member and the ornament as a driven member, which activate the ornament to operate by fully using the magnetic force, so that the structure inside the glass ball is more simplicity.

DETAILED DESCRIPTION OF THE PREFERRED EMBODIMENTS

Figure 1:
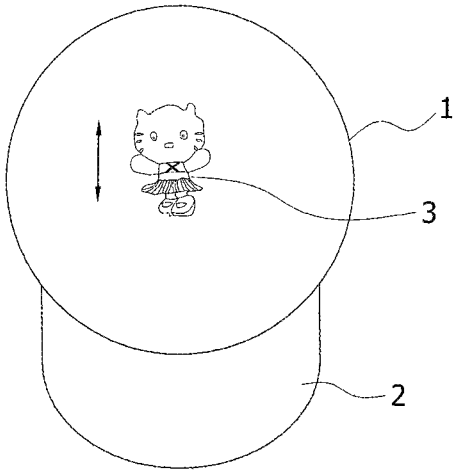
FIG. 1 is a schematic view of a first embodiment in operation.
Figure 2:
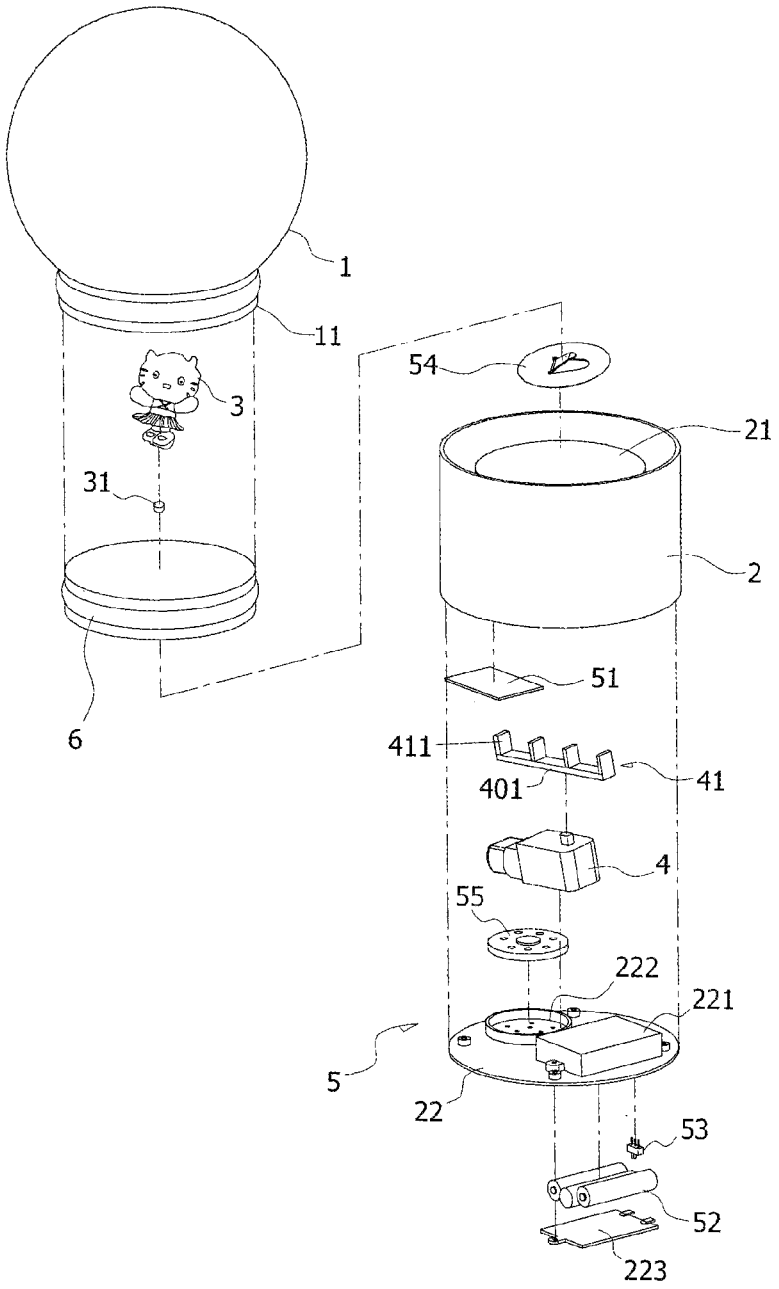
FIG. 2 is an exploded view of a first embodiment.

The first embodiment as shown in FIG. 1 and FIG. 2 comprises a hollow glass ball (1) and a base (2), an ornament (3) arranged inside the glass ball (1), the hollow glass ball (1) is used in the form of an opening (11) in its lower part, in which a conductive resin (6) is disposed; the base is provided with a concave (21) for receiving the opening (11) of the glass ball (1). In contrary, a circular convex is arranged around the outer side edge of the conductive resin (6), so that the combination of both can be more stably connection.

The ornament (3) is generally a doll, which is provided with an upper magnetic element (31) therebelow; the upper magnetic element (31) of the utility model is a magnetic, of which the directions of magnetic pole are distributed in up and down.

The base (2) is a hollow structure, which is internally provided with a gear box (4) driven by motor and an operating circuit (5).

The gear box (4) comprises a motor and a transmission mechanism which is driven by the motor, the turning moment is finally transmitted by an output shaft of the gear box (4). The output shaft of the gear box (4) is fixedly connected with a lower magnetic element (41) which can have the magnetic Interaction with the upper magnetic element (31), thereby, the output shaft of the gear box (4) drives the lower magnetic element (41), and then the magnetic Interaction between the upper (31) and the lower magnetic element (41), so as to drive the ornament (3) for operation.

The output shaft of the gear box (4) is fixedly connected with a connecting board (401) on which a on which the lower magnetic element (41) is arranged, and comprises a plurality of magnetics (411) in different directions of magnetic pole. These magnetics (411) are strip structures, of which the directions of magnetic pole are arrayed in up and down, some N poles of them are distributed in an upward direction, and the others are distributed in a downward direction, so that some magnetics (411) cause attraction with the upper magnetic element (31) and the rest are cause repulsion therewith. Since the connecting board (401) was turning by the gear box (4), the two forces are respectively working on the upper magnetic element (31), thus the ornament (3) shows upward (in the onset repulsion effect) or downward (in gravity or onset attraction effect) as a "dance" action.

The motor of the gear box (4) is connected to the operating circuit (5) which comprises a circuit board (51), a power source (52), a switch (53) and an electrode plate (54), said power source (52) is the battery or the direct current supply.

An electrode plate (54) is arranged under the conductive resin (6) and connected to the operating circuit (5), before starting the operation, turn the switch (53) on, the operating circuit (5) is still not receiving any static electricity at this point. Since the human body touched the glass ball (1), the static electricity transmitted to the circuit board (51) through the conductive resin (6) and electrode plate (54) that the operation is being started. At this point, the gear box (4) start to work, and the connecting board (401) are rotated driven by the gear box (4), so as to activate the ornament (3) to "dance".

For increasing the interesting of the utility model, the glass ball (1) can refilled with liquid such as water. Because the liquid can produce a certain buoyancy, the effect of the product looks more like a "dancing in the water". Simultaneously, water is a conductor so as to facilitate the static electricity transmission.

For increasing the interesting of the utility model, the operating circuit (5) is further provided with a speaker (55), a control chip of the circuit board (51) integrates some audio applications, when the operating circuit (5) begin to work, the speaker (55) play music, and the ornament (3) operates under the music that is more interesting.

Besides, the base (2) is a hollow structure which is provided with a bottom cover (22) therebelow and a battery box (221) and a groove (222) for fixing the speaker (44). The battery box is further provided with a cover plate (223) to facilitate changing battery.

Figure 3:
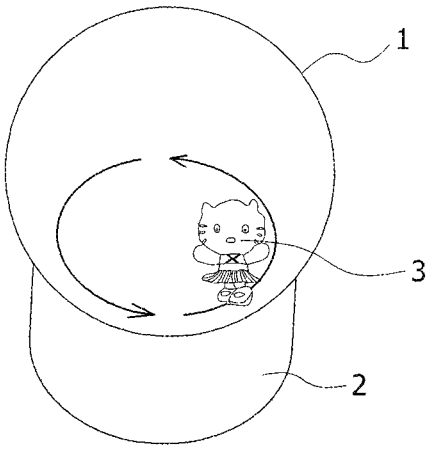
FIG. 3 is a schematic view of second embodiment in operation.
Figure 4:
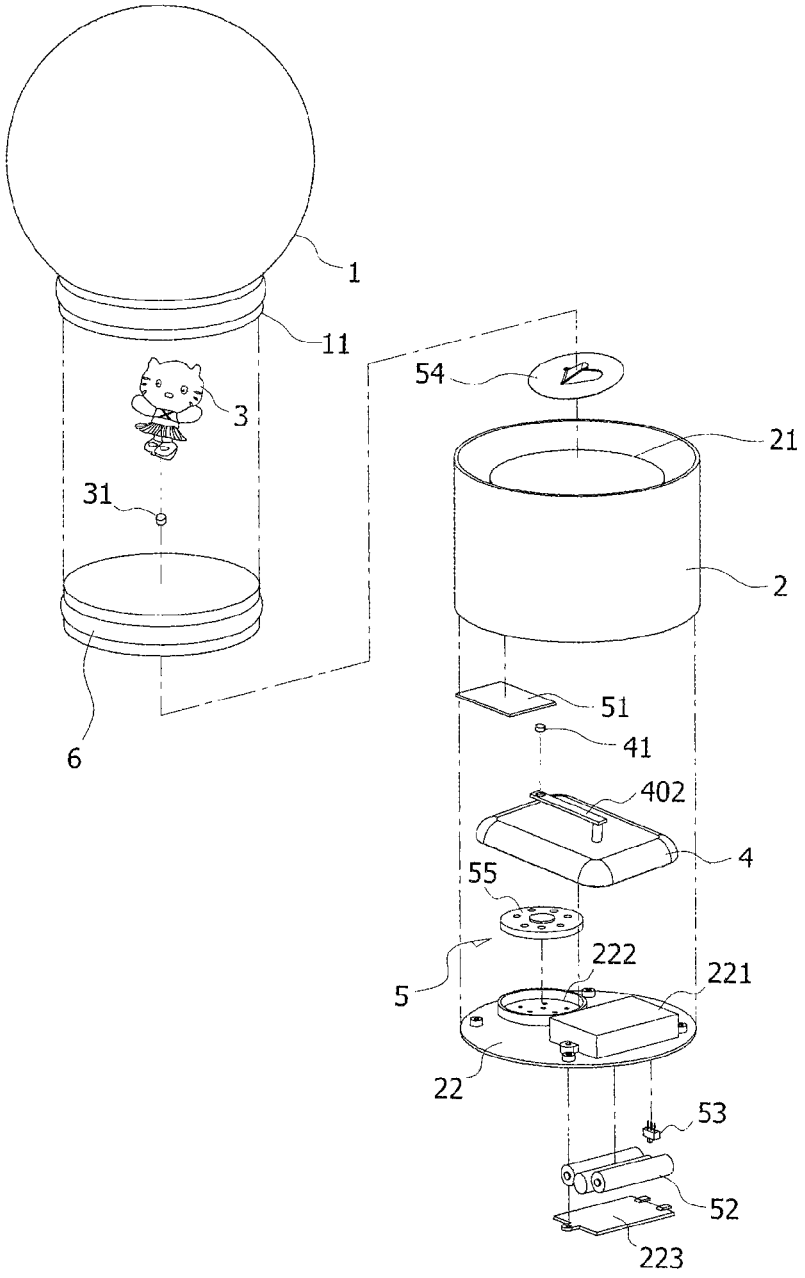
FIG. 4 is an exploded view of a second embodiment.

The second embodiment as shown in FIG. 3 and FIG. 4, the disclosure is pretty much the same as the first embodiment, the differences are as follow:

The action of the ornament (3) in first embodiment is the dance, but the action of the second one is the rotation.

The output shaft of the gear box (4) is fixedly connected with a pendulum rod (402) on which the lower magnetic element (41) is arranged, wherein the lower magnetic element (41) is a magnetic disposed on pendulum rod (402) and at the end away from the output shaft. The directions of the magnetic pole in the lower magnetic element (41) are distributed in up and down, the upper magnet element (31) is the magnetic, of which the directions of magnetism are distributed in up and down, and the direction of the magnetic pole in the lower magnetic element (41) is the same as the upper magnet element (31). When the pendulum rod (402) is rotating driven by the gear box (4), the ornament is pulled by attraction effect which is caused between upper and lower magnetic element (31, 41), turning around the conductive resin (6) continuously, led to the ornament as a "dance" action. The second embodiment also can filled with liquid into the glass ball (1).

Figure 5:
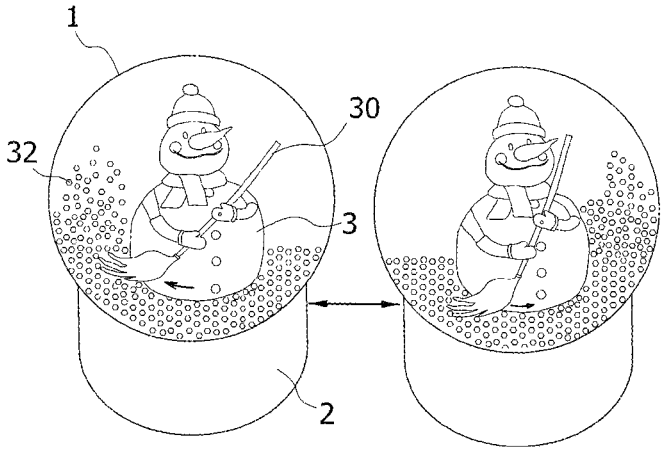
FIG. 5 is a schematic view of a third embodiment in operation.
Figure 6:
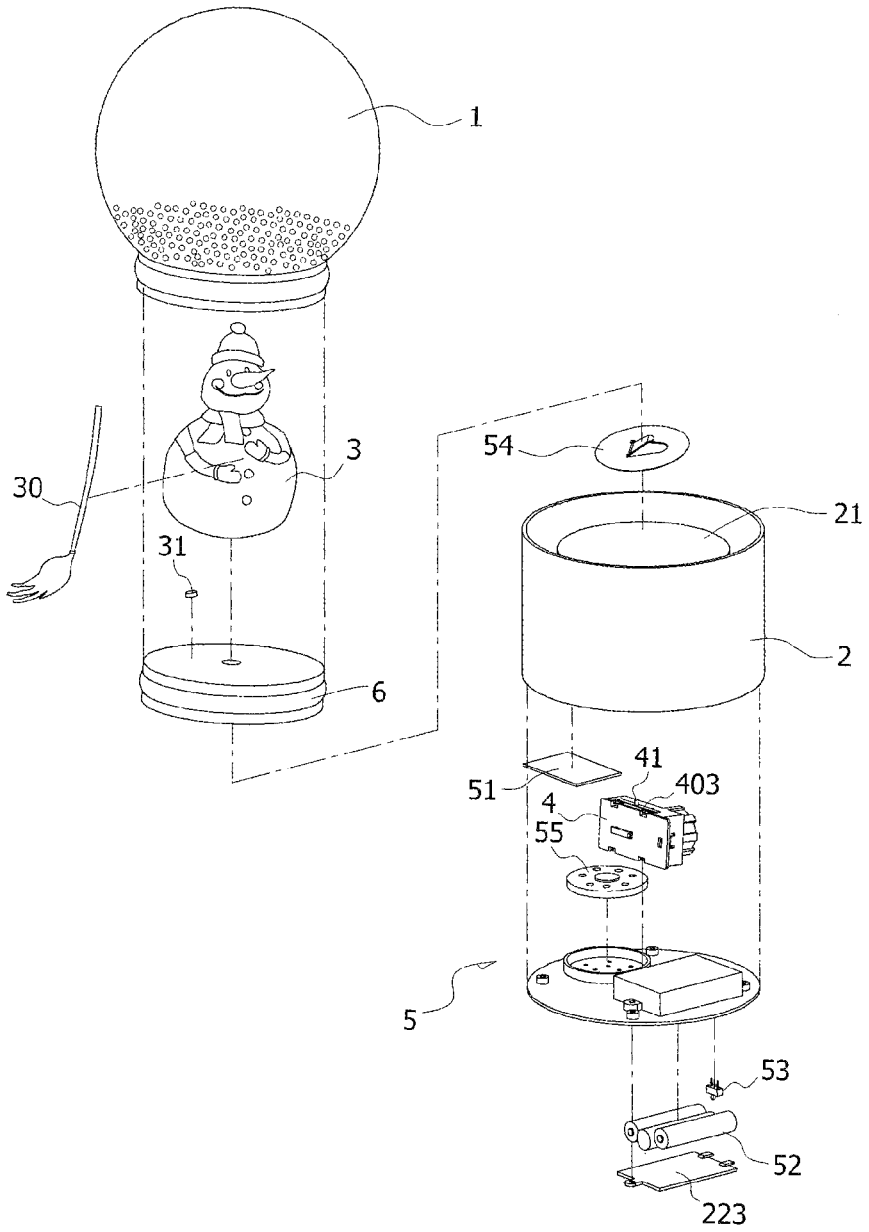
FIG. 6 is an exploded view of a third embodiment.

The third embodiment as shown in FIG. 5 and FIG. 6, the differences of third one are the output terminal of the gear box is a connecting board (403) capable of reciprocating motion, on which the lower magnetic element (41) is arranged;

The ornament (3) is provided with a swing element (30), the upper magnet element (31) disposed therebelow;

The directions of the magnetic pole in the lower magnetic element (41) are the same as the upper magnet element (31), the gear box (4) drives the lower magnetic element of connecting board (403) to do reciprocating motion, so the swing element (30) of the upper magnetic element (31) is being swung by the attraction of the magnetic. The swing action act like a snowman is sweeping snow, the glass ball (1) can add some particles (32) to look like snowflakes.

The second and the third embodiments are adopted in touch sensitive method, the disclosures are the same as the first one, the specific process will not to repeat them here.

With specific reference now to the figures in detail, it is stressed that the particulars shown are by way of example and for purposes of illustrative discussion of the preferred embodiments of the present invention only, and are presented in the cause of providing what is believed to be the most useful and readily understood.

I claim:

1. A touch sensitive crystal ball, comprising:

a hollow glass ball (1) and a base (2); said hollow glass ball (1) having an opening (11) in a lower part therebelow, and a conductive resin (6) disposed in said opening (11); the base (2) provided with an operating circuit (5) therein; an electrode plate (54) arranged under the conductive resin (6) and connected to the operating circuit (5); a touch switch being composed of the electrode plate (54), the glass ball (1) and the conductive resin (6); when the user touch the glass ball (1), the operating circuit (5) is opened by activating the electrode plate (54) through static electricity from human body;

wherein the glass ball (1) is provided with an ornament (3) therein, and an upper magnet element (31) arranged under the ornament (3); the base (2) having a gear box (4) driven by a motor, said gear box (4) having an output shaft linked with a lower magnetic element (41) which is interacted with the upper magnet element (31) by magnetic force; the output shaft of gear box (4) drives the lower magnetic element (41) for operation by the magnetic force between the upper and lower magnetic elements (31,41), thereby activating the ornament (3) located inside the glass ball (1); the motor of the gear box (4) connected to the operating circuit (5);

wherein said output shaft of the gear box (4) is fixedly connected with a connecting board (401) on which the lower magnetic element (41) is arranged; wherein said lower magnetic element (41) comprises a plurality of magnetics (411) distributed thereon with different directions of magnetic pole;

wherein said directions of magnetic pole in the magnetics (411) are distributed in up and down; wherein the upper magnet element (31) is a magnetic, of which the directions of magnetism are distributed in up and down.

2. The touch sensitive crystal ball according to claim 1, wherein the glass ball (1) is filled with liquid.

* * * * *